US007817032B2

(12) United States Patent
Wilcox

(10) Patent No.: US 7,817,032 B2
(45) Date of Patent: Oct. 19, 2010

(54) MULTIPLE ARTICLE LOCATING SYSTEM AND ASSOCIATED METHOD

(76) Inventor: Karen Wilcox, 449 Locust St., Hammonton, NJ (US) 08037

( * ) Notice: Subject to any disclaimer, the term of this patent is extended or adjusted under 35 U.S.C. 154(b) by 497 days.

(21) Appl. No.: 11/809,581

(22) Filed: Jun. 2, 2007

(65) Prior Publication Data

US 2007/0279220 A1 Dec. 6, 2007

Related U.S. Application Data

(60) Provisional application No. 60/810,822, filed on Jun. 5, 2006.

(51) Int. Cl.
*G08B 1/08* (2006.01)

(52) U.S. Cl. ..... 340/539.32; 340/572.1; 340/691.3; 340/825.49

(58) Field of Classification Search ..... 340/539.32, 340/572.1, 825.49, 539.13, 568.1, 328, 691.3, 340/505

See application file for complete search history.

(56) References Cited

U.S. PATENT DOCUMENTS

| | | | | |
|---|---|---|---|---|
| 5,673,023 | A * | 9/1997 | Smith | 340/571 |
| 5,677,673 | A * | 10/1997 | Kipnis | 340/539.32 |
| 6,480,147 | B2 * | 11/2002 | Durst et al. | 342/357.07 |
| 7,064,663 | B2 * | 6/2006 | Pucci et al. | 340/539.32 |
| 7,209,075 | B2 * | 4/2007 | Durst et al. | 342/357.1 |
| 7,375,632 | B1 * | 5/2008 | Sebanc | 340/572.1 |
| 7,466,992 | B1 * | 12/2008 | Fujisaki | 455/556.1 |
| 2005/0080566 | A1 * | 4/2005 | Vock et al. | 702/2 |
| 2005/0134459 | A1 * | 6/2005 | Glick et al. | 340/572.1 |

* cited by examiner

*Primary Examiner*—Daniel Previl

(57) ABSTRACT

The system includes a hand-held central monitoring device including an antenna and a receiver. A display screen is electrically coupled to a signal potency evaluating circuit and an audio transducer is electrically coupled thereto. A plurality of labeled identification members are attached to the existing misplaced articles. A first tuned frequency transducer is electrically coupled to a tuned frequency signal generating module. A central monitoring device receives signals and a mechanism detects a location of the existing misplaced article. Labeled identification modules are removably attached to the misplaced articles.

15 Claims, 5 Drawing Sheets

MULTIPLE ARTICLE LOCATING SYSTEM AND ASSOCIATED METHOD

CROSS REFERENCE TO RELATED APPLICATIONS

This application claims the benefit of U.S. Provisional Application No. 60/810,822, filed Jun. 5, 2006, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to article locating devices and, more particularly, to a multiple article locating system for finding a plurality of misplaced user articles.

2. Prior Art

Since hectic and busy days are becoming more and more common in today's fast paced world, distractions are almost impossible to avoid, even in the household. Whether the telephone is ringing incessantly, children are insistent with demands, or breakfast is about to burn on the stove, it is quite simple to lose track of personal items when having to attend to so many tasks. Car keys, purses and wallets, medications, and even eyeglasses are seemingly sucked into some unknown abyss as on-the-go living stretches one's attention. When things have calmed, many face an extended search for necessary items, entirely unsure of where they possibly could have left them. Whether they have slipped between chair cushions or been absently placed in another room, locating these objects can be daunting and frustrating. As many consumers attest, furiously searching for these items can be extremely aggravating and time consuming, especially when running late for work or school or needing to take a required medication at a certain time.

U.S. Pat. No. 7,209,075 to Durst discloses a method and apparatus for an object locator system for requesting and obtaining information about the location of a mobile object, having attached thereon a lightweight object locator, operable in a region served by a two-way paging system and a global positioning satellite system. The object locator may be selectively activated to conserve power or enabled to respond only when beyond or within a boundary. Further, the object locator system may provide the location information in several forms including rectangular or polar coordinates referred to a base station or origin, position on a map display, etc. In alternate embodiments the two-way paging system may be substituted by a direct wireless link or a satellite relay communications link; the location information may be translated into human readable form either before or after transmission from the object locator; the location information may be presented at an output as selectable text; spoken message or graphic display including a map; the location information may have associated therewith other information such as time the location was determined, the status of the object locator, the condition of the battery, position of the object locator relative to a boundary or electronic fence or to indicate an alarm condition; or the location information may be accessed or delivered by dial-up or automatic means. Unfortunately, this prior art example does not provide a means for finding multiple objects with the use of only one transceiver.

U.S. Pat. No. 6,480,147 to Durst discloses a satellite navigation receiver for automatically providing computed position information, when the device has changed its position relative to a predetermined location, to a paging transmitter for transmission to a paging receiver for readout of the computed position information. The readout may be in the form of coordinates and may be accompanied by a message or alarm. The device may be configured as a portable unit of small size and economical manufacture. Unfortunately, this prior art example does not provide a means for finding multiple objects with the use of only one transceiver.

U.S. Pat. No. 6,441,778 to Durst discloses a locating device for attachment to an animal and adapted to obtain and communicate location information about the animal to a base station. The device is comprised of a controller having an input for location data and a first communication port; a satellite navigation system receiver coupled to a first antenna and having a location data output coupled to the location data input of said controller; a communication transceiver coupled to a second antenna to receive and transmit communications between the locating device and the base station and having a second communication port coupled to the first communication port of the controller; and a housing to enclose the controller, the satellite navigation system receiver and communication transceiver, configured to be attached to the animal. The controller upon activation operates automatically to obtain location data from the satellite navigation system receiver via the location data output, store the location data in the memory and cause the location data to be accessed from the memory, coupled to the communication transceiver and transmitted to the base station. Unfortunately, this prior art example does not provide a means for finding multiple objects with the use of only one transceiver.

Accordingly, the present invention is disclosed to overcome the above noted shortcomings. The present invention satisfies such a need by providing a system that is convenient and easy to use, lightweight yet durable in design, and designed for finding multiple misplaced user articles.

The multiple article locator system would effectively assist a user in quickly locating misplaced objects that are essential to daily routine. Eliminating the need to fruitlessly dig through chair cushions, to crawl on the floor to search underneath furniture, or to root through every drawer in the house, the present invention would pinpoint the location of an elusive item in a matter of seconds. As a result, precious minutes would not be wasted on busy days when time is in short supply. Easy to operate, a simple push of the transmitting button would emit a loud and clear sound that can be heard from practically anywhere in the home. In this manner, the present invention is ideal for use by children as well as adults. The elderly and those who suffer from limited physical capabilities would certainly benefit from the time saving benefits afforded by this effortless product. The present invention is simple to use, inexpensive, and designed for many years of repeated use.

BRIEF SUMMARY OF THE INVENTION

In view of the foregoing background, it is therefore an object of the present invention to provide a system for assisting a user to find a plurality of misplaced user articles. These and other objects, features, and advantages of the invention are provided by a multiple article locator system.

The system includes a hand-held central monitoring device including a mechanism for generating and transmitting a first signal based upon a user input. Such a central monitoring device further includes an antenna and a receiver electrically coupled thereto. Such a receiver conveniently receives the second signal from a detected one of the labeled identification modules. A signal potency evaluating circuit is electrically coupled to the receiver for determining a signal potency of the second signal. A display screen is electrically coupled to such a signal potency evaluating circuit for visually displaying a graphical image of a potency level of the second signal. An audio transducer is electrically coupled to the signal potency evaluating circuit, and the audio transducer effectively generates and emits an audible response signal corresponding to the potency level of the second signal.

The system further includes a plurality of labeled identification members attached to the existing misplaced articles. Each of the labeled identification members advantageously includes a mechanism for generating and transmitting a second signal responsive to the first signal. Such a first signal generating and transmitting mechanism includes a plurality of controls and a tuned frequency signal generating module electrically coupled in series to the controls. Such a tuned frequency signal generating module conveniently generates the first signal based upon a user pressing a selected one of the controls wherein each of the first signals has a unique frequency level.

The labeled identification members further include a first tuned frequency transducer electrically coupled to the tuned frequency signal generating module. Such a tuned frequency transducer effectively receives and transforms the first tuned frequency signal to a signal wave. The first signal advantageously includes a coded data stream corresponding to a predetermined frequency code of a corresponding one of the radio frequency identification devices attached to one of the existing misplaced articles.

The system further includes a central monitoring device that receives the second signal and further includes a mechanism for detecting a location of the existing misplaced article based upon a potency level of the received second signal. Such a second signal generating and transmitting mechanism includes a unique radio frequency identification device for conveniently receiving and verifying the first signal and a second tuned frequency transducer electrically coupled to the radio frequency identification device. Such a second transducer is effectively activated upon receiving the first signal.

A power conditioning circuit is electrically coupled to the second transducer, and the power conditioning circuit advantageously rectifies an alternating voltage generated by the second transducer such that a rectified voltage is generated. A radio frequency transmitter is electrically coupled to the power conditioning circuit and is conveniently activated upon receipt of the rectified voltage. Such a radio frequency transmitter generates and transmits a second radio frequency signal response to the first signal.

The system further includes labeled identification modules that are removably attached to the misplaced articles, and an amplitude level of the rectified voltage is directly proportional to an intensity level of the signal wave.

A method for finding a plurality of existing misplaced articles includes the steps of: providing a hand-held central monitoring device with a plurality of controls and an antenna; from the central monitoring device, generating and transmitting a first signal based upon a user input; attaching a plurality of labeled identification members to the existing misplaced articles; selected ones of the labeled identification members generating and transmitting a second signal responsive to the first signal; the central monitoring device receiving the second signal; and detecting a location of the existing misplaced article based upon a potency level of the received second signal.

The method further includes the steps of: providing a tuned frequency signal generating module electrically coupled in series to the controls; the tuned frequency signal generating module generating the first signal based upon a user pressing a selected one of the controls wherein each of the first signals has a unique frequency level; providing a first tuned frequency transducer electrically coupled to the tuned frequency signal generating module; and the tuned frequency transducer receiving and transforming the first tuned frequency signal to a signal wave.

The method further includes the steps of: providing a unique radio frequency identification device; the unique radio frequency identification device receiving and verifying the first signal; providing a second tuned frequency transducer electrically coupled to the radio frequency identification device; activating the second transducer upon receiving the first signal; providing a power conditioning circuit electrically coupled to the second transducer; the power conditioning circuit rectifying an alternating voltage generated by the second transducer such that a rectified voltage is generated; and providing a radio frequency transmitter electrically coupled to the power conditioning circuit; activating the radio frequency transmitter upon receipt of the rectified voltage; and the radio frequency transmitter generating and transmitting a second radio frequency signal response to the first signal.

The method further includes the steps of: providing a receiver electrically coupled to the antenna; the receiver receiving the second signal from a detected one of the labeled identification modules; providing a signal potency evaluating circuit electrically coupled to the receiver; the signal potency evaluating circuit determining a signal potency of the second signal; providing a display screen electrically coupled to the signal potency evaluating circuit; the display screen visually displaying a graphical image of a potency level of the second signal; providing an audio transducer electrically coupled to the signal potency evaluating circuit; and the audio transducer generating and emitting an audible response signal corresponding to the potency level of the second signal.

The first signal includes a coded data stream corresponding to a predetermined frequency code of a corresponding one of the radio frequency identification devices attached to one of the existing misplaced articles, and an amplitude level of the rectified voltage is directly proportional to an intensity level of the signal wave.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
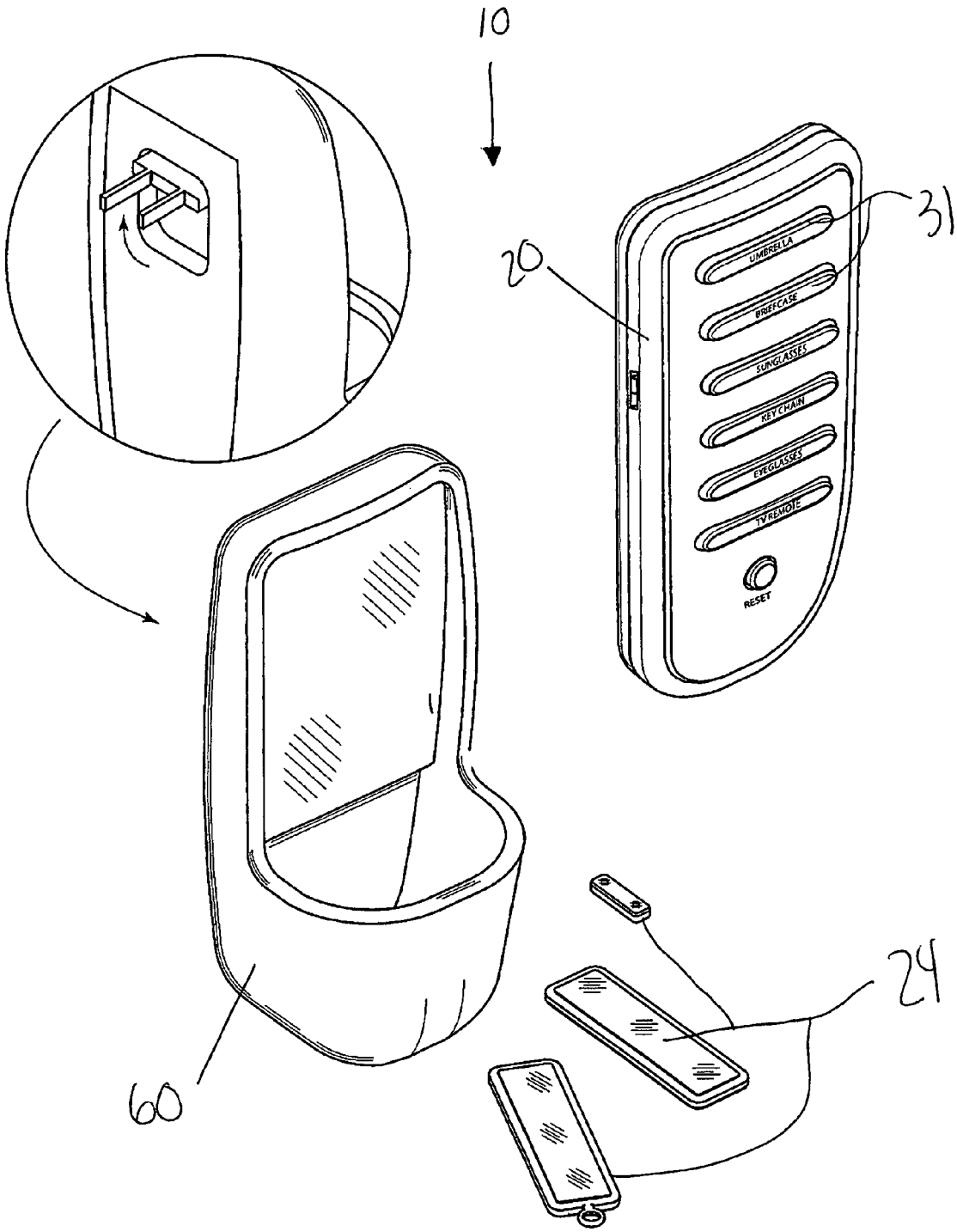
FIG. 1 is a perspective view showing a multiple article locating system, in accordance with the present invention.
Figure 2:
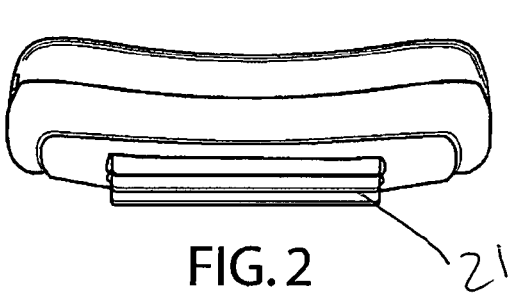
FIG. 2 is a bottom planar view of the central monitoring device, in accordance with the present invention.
Figure 3:
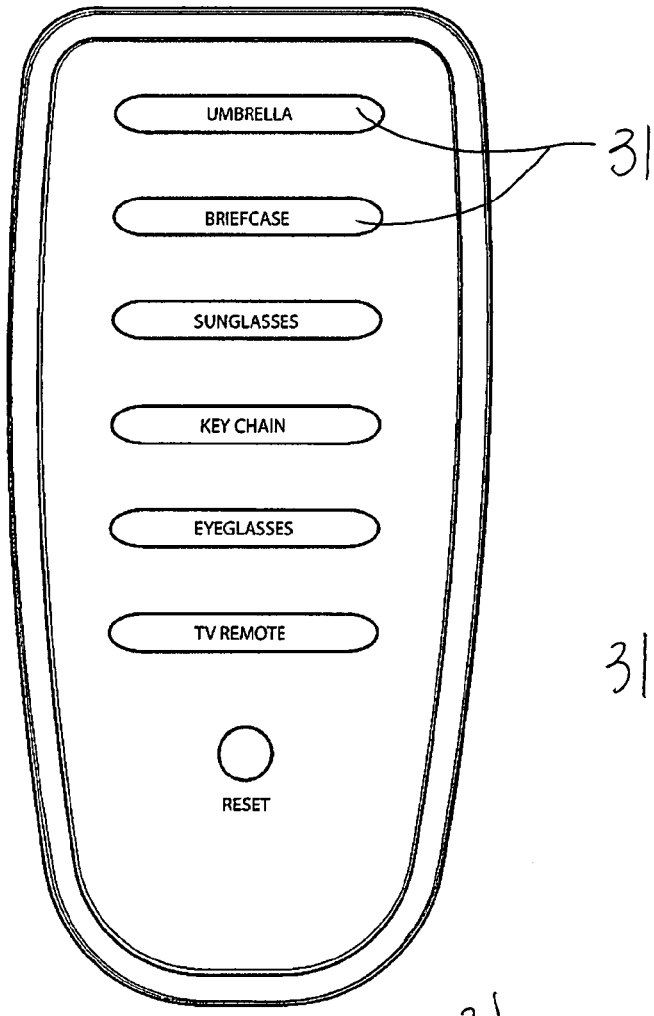
FIG. 3 is a front elevational view of the central monitoring device, in accordance with the present invention.
Figure 4:
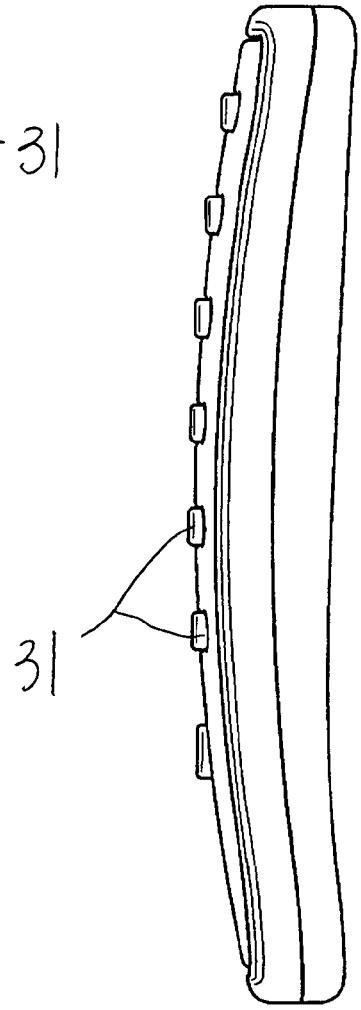
FIG. 4 is a side elevational view of the central monitoring device, in accordance with the present invention.
Figure 5:
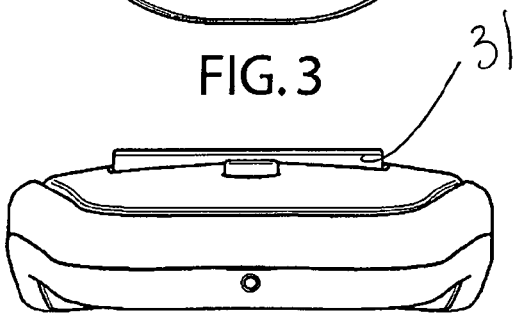
FIG. 5 is a top planar view of the central monitoring device, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The system of this invention is referred to generally in FIGS. 1-10 by the reference numeral 10 and is intended to protect a multiple article locating system. It should be understood that the apparatus 10 may be used to locate many different types of articles and should not be limited to locating only those types of articles mentioned herein.

Figure 6:
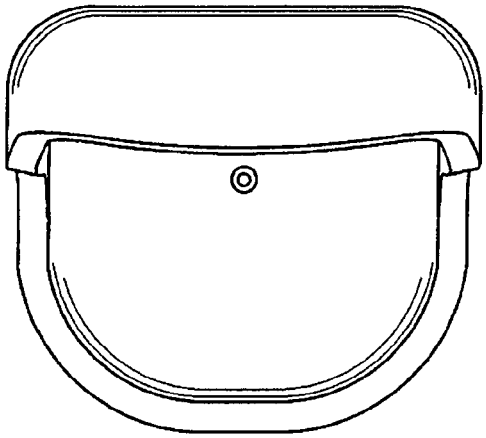
FIG. 6 is a top planar view of the charging station, in accordance with the present invention.
Figure 7:
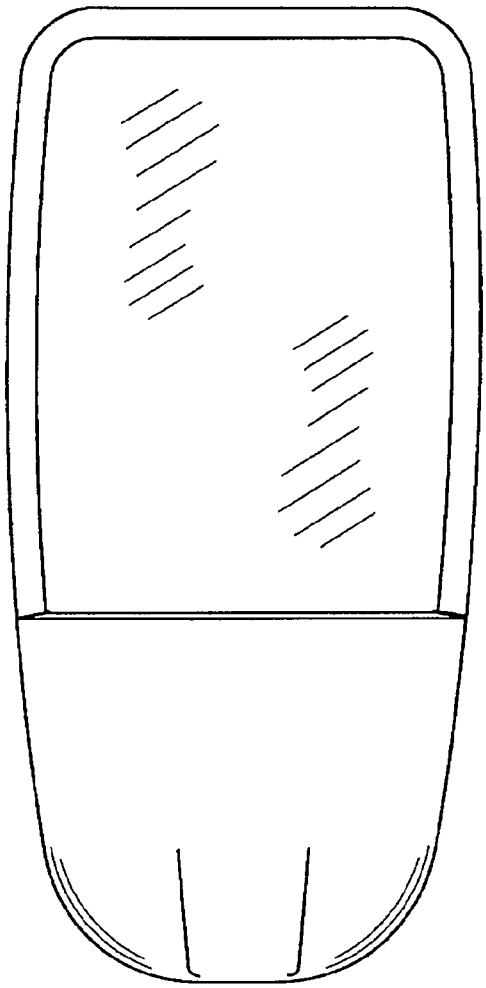
FIG. 7 is a front elevational view of the charging station, in accordance with the present invention.

FIGS. 1 through 5 show various perspective and elevational views of a universal article finding system. FIGS. 6-7 show block diagram representations of the circuitry contained in a hand-held central monitoring device (CMD) and a plurality of labeled identification members (LIM) 24 that are attached or embedded into an article to be found. The CMD 20 is used to direct a user to the LIM 24 and hence the article to be found. The user activates the CMD 20 by means of a user interface 50 that supplies electrical power to the CMD 20.

Before the misplaced articles can be found, each LIM must be equipped with a unique radio frequency identification device (RFID). Various RFIDs may be employed, as known by those skilled in the art. For example, U.S. Pat. No. 7,212,125 discloses an RFID architecture that is suitable for the present invention. Short distance wireless transfer, like infrared wave, or direct connecting between the LIM and the CMD may be used to activate the RFID. The identification assignment can be done in the manufacturer's factory, as well. To avoid accidental erasure of the identification, it may be made of a type of read-only memory, like ROM, PROM, EPROM, EEPROM, etc.

In the central monitoring device, a tuned frequency signal is generated by a tuned frequency signal generating module 32 and coupled to a tuned frequency transducer 34. For example, the user seeking to locate the misplaced article will press a corresponding control 31 on the CMD 20 associated with the LIM 24 attached to the misplaced article. The generated signal includes a coded data stream corresponding to a prescribed frequency code of the RFID attached to the misplaced article. The transducer 34 converts the tuned frequency generated signal to a tuned frequency generated signal wave 36. Tuned frequency generated signal waves have a directional nature and, therefore, travel in a confined ray from the transducer 34. The user adapts the CMD 20 in a way such that the tuned frequency generated signal wave 36 is caused to cover a search area where the article to be found may have been misplaced.

As the tuned frequency generated signal wave 36 is caused to fall onto the LIM 24, the tuned frequency generated signal wave 36 excites a tuned frequency transducer 34 in the LIM 24, upon verification by the RFID. The excitation of the transducer 34 induces an alternating voltage in the transducer 34 that is rectified and conditioned by a power conditioner circuit 40, well known in the art. The conditioned voltage is used to power a radio frequency (RF) transmitter 41. The amplitude of the alternating voltage induced in the transducer 34 and hence the conditioned voltage is directly proportional to the intensity of the tuned frequency generated signal wave 23 that excites it.

The radio frequency transmitter 41 generates a second radio frequency signal that is coupled for transmission to an antenna 21. The CMD 20, using an antenna 21 and receiver 22 receives the second radio frequency signal from the LIM 24. The signal strength of the received radio frequency signal is determined by a signal potency evaluating circuit (SPEC) 25. Such circuits are well known in the art such as the one disclosed by U.S. Pat. No. 4,247,949, for example. The SPEC 25 activates a screen 26 and an audio transducer 28 corresponding to the signal strength of the received radio frequency signal. The direction of the CMD 20 that indicates maximum signal strength at a particular orientation indicates the direction of the LIM 24. Additionally the maximum signal strength at a particular location represents a calculation of the distance between the CMD 20 and the LIM 24.

The radio frequency transmitter 41 can be preprogrammed to generate a unique signal to prevent its output radio frequency signal from being received by another receiver. The radio frequency transmitter 41 and receiver 22 therefore eliminate and prohibit communication with other transmitters and receivers operating in the vicinity of the transmitter 41—receiver 22 twosome. This can be accomplished in many ways. One particular way involves the use of a PIN code as in garage door openers where the transmitter outputs a radio frequency signal of predetermined frequency and having a coded digital output that uniquely identifies the transmitter. The coded PIN number is detected and decoded by the receiver 22 and discarded if the PIN code does not match the preprogrammed code into the receiver 22. If the PIN code does match, then the signal is passed to the signal strength detector circuit 25. In this way, the CMD 20 can be used with multiple LIMs 24.

Referring initially to FIGS. 1, 2, 3, 4, 5, 9 and 10, the system includes a hand-held central monitoring device 20 including a mechanism for generating and transmitting a first signal based upon a user input. Such a central monitoring device 20 further includes an antenna 21 and a receiver 22 electrically coupled thereto. Such a receiver 22 conveniently receives the second signal 23 from a detected one of the labeled identification modules 24. A signal potency evaluating circuit 25 is electrically coupled to the receiver 22 for determining a signal potency of the second signal 23. A display screen 26 is electrically coupled to such a signal potency evaluating circuit 25 for visually displaying a graphical image of a potency level of the second signal 23. An audio transducer 28 is electrically coupled to the signal potency evaluating circuit 25, and the audio transducer 28 effectively generates and emits an audible response signal corresponding to the potency level of the second signal 23. The central monitoring device 20 allows a user to select a specific article to locate and indicates to a user the proximity of the article in relation to the central monitoring device.

Referring again to FIGS. 1, 2, 3, 4, 5, 9 and 10, the system further includes a central monitoring device 20 that receives the second signal 23 and further includes a mechanism for detecting a location of the existing misplaced article based upon a potency level of the received second signal 23. Such a first signal generating and transmitting mechanism 30 includes a plurality of controls 31 and a tuned frequency signal generating module 32 electrically coupled in series to the controls 31. Such a tuned frequency signal generating module 32 conveniently generates the first signal 33 based upon a user pressing a selected one of the controls 31 wherein each of the first signals 33 has a unique frequency level. The plurality of labeled identification members 24 allows a user to choose to mark only those items which are most often misplaced by a user.

Figure 9:
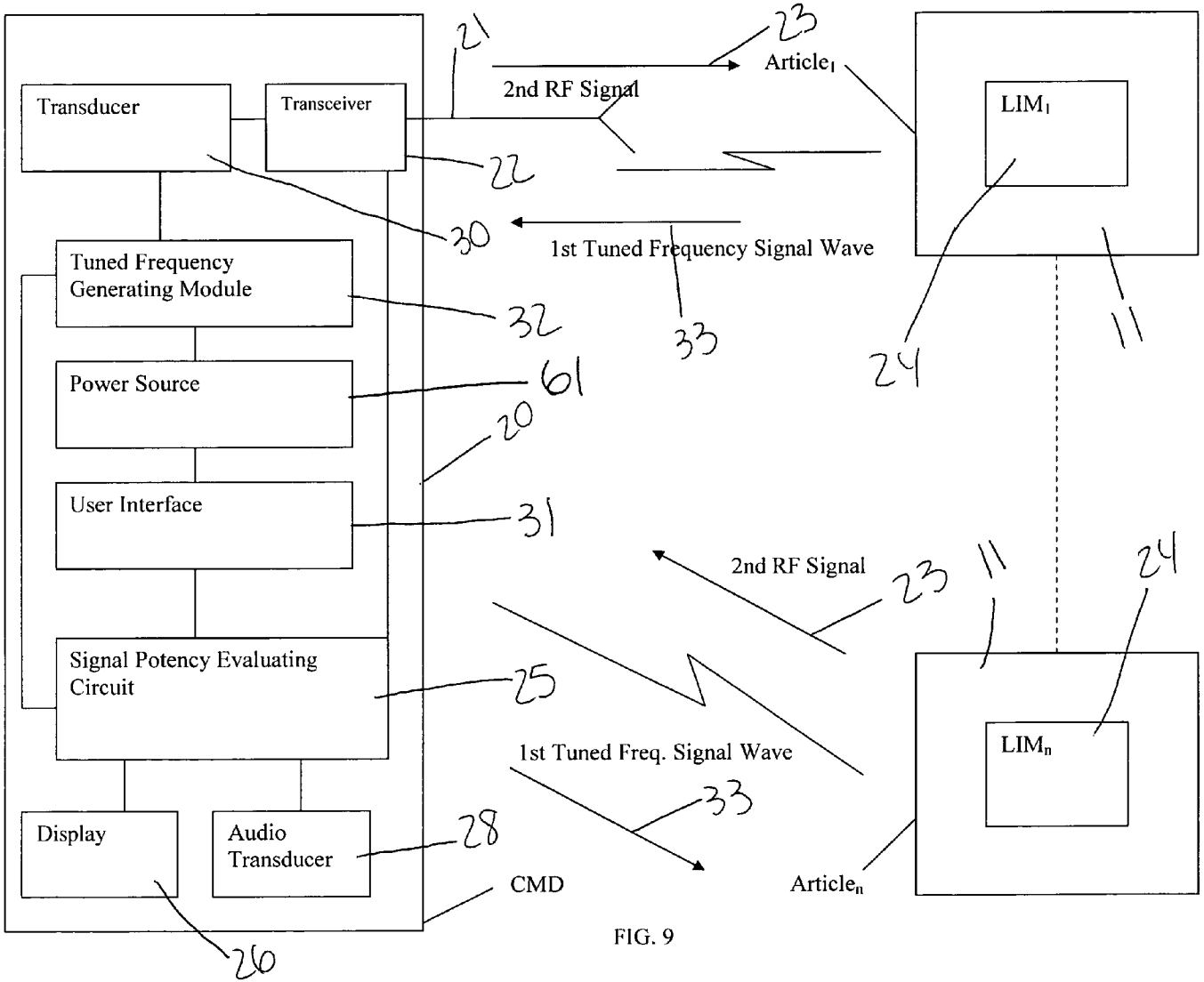
FIG. 9 is a schematic block diagram of the present invention.
Figure 10:
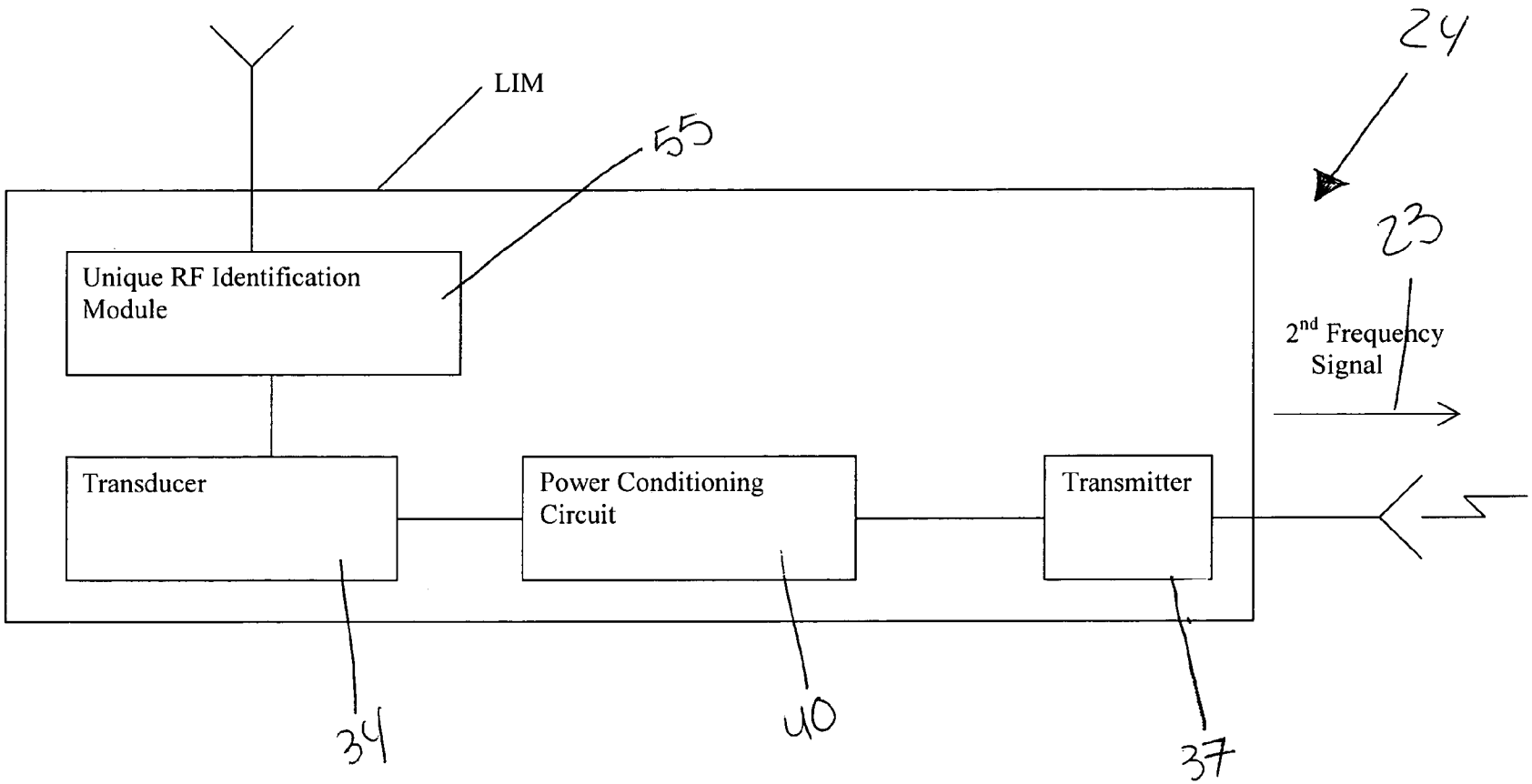
FIG. 10 is a schematic block diagram of a labeled identification member, in accordance with the present invention.

Referring to FIGS. 1, 9 and 10, the system further includes a plurality of labeled identification members 24 attached to the existing misplaced articles 11. Each of the labeled identification members 24 advantageously includes a mechanism for generating and transmitting a second signal responsive to the first signal. Such a second signal generating and transmitting mechanism 37 includes a unique radio frequency identification 55 device for conveniently receiving and verifying the first signal and a second tuned frequency transducer 34 electrically coupled to the radio frequency identification device 55. Such a second transducer 34 is effectively activated upon receiving the first signal 33. The second signal 23 and transmitting mechanism verifies the location of the misplaced article and produces a response to establish the general area in which the lost article is located.

Referring again to FIGS. 1, 9 and 10, the labeled identification members 24 further include a first tuned frequency transducer 34 electrically coupled to the tuned frequency signal generating module 55. Such a tuned frequency transducer 34 effectively receives and transforms the first tuned frequency signal 33 to a signal wave. The first signal 33 advantageously includes a coded data stream corresponding to a predetermined frequency code of a corresponding one of the radio frequency identification devices attached to one of the existing misplaced articles.

Referring to FIGS. 9 and 10, a power conditioning circuit 40 is electrically coupled to the second transducer 34, and the power conditioning circuit 40 advantageously rectifies an alternating voltage generated by the second transducer 34 which is essential such that a rectified voltage is generated. A radio frequency transmitter 37 is electrically coupled to the power conditioning circuit 40 and is conveniently activated upon receipt of the rectified voltage. Such a radio frequency transmitter 37 generates and transmits a second radio frequency signal 23 response to the first signal. The radio frequency transmitter generates a sound in order to allow a user to help locate the lost article.

Referring again to FIGS. 9 and 10, the system further includes labeled identification modules 24 that are removably attached to the misplaced articles 11, and an amplitude level of the rectified voltage is directly proportional to an intensity level of the signal wave. The sound intensity emanated from the labeled identification modules is proportional in loudness to how close a user is to the misplaced object.

Figure 8:
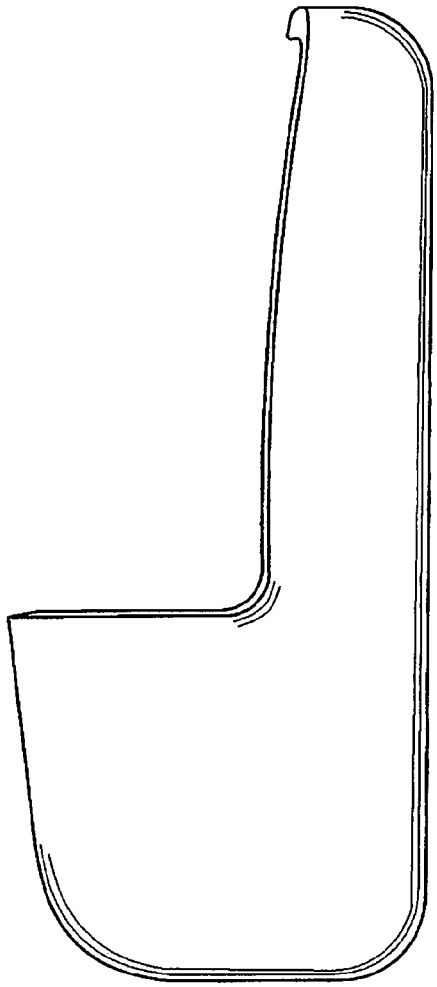
FIG. 8 is a side elevational view of the charging station, in accordance with the present invention.

Referring to FIGS. 6, 7 and 8, the system further includes a base station 60 for recharging the central monitoring device 20. Such a base station conveniently recharges the power source 61 of the central monitoring device 20. The base station should be plugged into an electrical outlet and thereby also serves as an effective means for storing the central monitoring device 20.

The central monitoring device 20 provides the unexpected benefit of allowing a user to locate various objects using the same device. The plurality of labeled identification members 24 may be attached to various different articles 11 and thereby provide a user the added benefit of marking only those articles that are most often misplaced by the user. Such benefits overcome the prior art shortcomings.

In use, the multiple article locating system is simple and straightforward to use. A method for finding a plurality of existing misplaced articles includes the steps of: providing a hand-held central monitoring device 20 with a plurality of controls 31 and an antenna 21; from the central monitoring device 20, generating and transmitting a first signal 33 based upon a user input; attaching a plurality of labeled identification members 24 to the existing misplaced articles 11; selected ones of the labeled identification members 24 generating and transmitting a second signal 23 responsive to the first signal 33; the central monitoring device 20 receiving the second signal 23; and detecting a location of the existing misplaced article 11 based upon a potency level of the received second signal.

In use, the method further includes the steps of: providing a tuned frequency signal generating module 32 electrically coupled in series to the controls 31; the tuned frequency signal generating module 32 generating the first signal 33 based upon a user pressing a selected one of the controls 31 wherein each of the first signals 33 has a unique frequency level; providing a first tuned frequency transducer 30 electrically coupled to the tuned frequency signal generating module 32; and the tuned frequency transducer 30 receiving and transforming the first tuned frequency signal to a signal wave 33.

In use, the method further includes the steps of: providing a unique radio frequency identification device 55; the unique radio frequency identification device 55 receiving and verifying the first signal 33; providing a second tuned frequency transducer 34 electrically coupled to the radio frequency identification device 55; activating the second transducer 34 upon receiving the first signal 33; providing a power conditioning circuit 40 electrically coupled to the second transducer 34; the power conditioning circuit 40 rectifying an alternating voltage generated by the second transducer 34 such that a rectified voltage is generated; and providing a radio frequency transmitter 37 electrically coupled to the power conditioning circuit 40; activating the radio frequency transmitter 37 upon receipt of the rectified voltage; and the radio frequency transmitter 37 generating and transmitting a second radio frequency signal 23 response to the first signal 33.

In use, the method further includes the steps of: providing a receiver 22 electrically coupled to the antenna 21; the receiver receiving the second signal 23 from a detected one of the labeled identification modules 24; providing a signal potency evaluating circuit 25 electrically coupled to the receiver 22; the signal potency evaluating circuit 25 determining a signal potency of the second signal 23; providing a display screen 26 electrically coupled to the signal potency evaluating circuit 25; the display screen 26 visually displaying a graphical image of a potency level of the second signal 23; providing an audio transducer 28 electrically coupled to the signal potency evaluating circuit 25; and the audio transducer 28 generating and emitting an audible response signal 29 corresponding to the potency level of the second signal.

The first signal 33 includes a coded data stream corresponding to a predetermined frequency code of a corresponding one of the radio frequency identification devices attached to one of the existing misplaced articles, and an amplitude level of the rectified voltage is directly proportional to an intensity level of the signal wave. In use, the method further includes the step of providing a base station 61 for recharging the power source of the central monitoring device 20 and providing a means for storing the central monitoring device 20.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A wireless system for finding a plurality of existing misplaced articles, said wireless system comprising:

a hand-held central monitoring device including means for generating and transmitting a first signal based upon a user input;

a plurality of labeled identification members attached to the existing misplaced articles, each of said labeled identification members including means for generating and transmitting a second signal responsive to said first signal; and wherein said hand-held central monitoring device receives said second signal and further includes means for detecting a location of the existing misplaced article based upon a potency level of said received second signal;

wherein said first signal generating and transmitting means comprises:

a plurality of controls;

a tuned frequency signal generating module electrically coupled in series to said controls, said tuned frequency signal generating module generating said first signal based upon a user pressing a selected one of said controls wherein said first signal has a unique frequency level; and a first tuned frequency transducer electrically coupled to said tuned frequency signal generating module, said tuned frequency transducer receiving and transforming said first tuned frequency signal to a signal wave.

2. The wireless system of claim 1, wherein said second signal generating and transmitting means comprises:

a unique radio frequency identification device for receiving and verifying said first signal;

a second tuned frequency transducer electrically coupled to said radio frequency identification device, said second transducer being activated upon receiving said first signal;

a power conditioning circuit electrically coupled to said second transducer, said power conditioning circuit rectifying an alternating voltage generated by said second transducer such that a rectified voltage is generated; and a radio frequency transmitter electrically coupled to said power conditioning circuit and being activated upon receipt of said rectified voltage, said radio frequency transmitter generating and transmitting a second radio frequency signal response to said first signal.

3. The wireless system of claim 2, wherein said central monitoring device further comprises:

an antenna;

a receiver electrically coupled thereto, said receiver receiving said second signal from a detected one of said labeled identification modules;

a signal potency evaluating circuit electrically coupled to said receiver for determining a signal potency of said second signal;

a display screen electrically coupled to said signal potency evaluating circuit for visually displaying a graphical image of a potency level of said second signal; and an audio transducer electrically coupled to said signal potency evaluating circuit, said audio transducer generating and emitting an audible response signal corresponding to said potency level of said second signal.

4. The wireless system of claim 3, wherein an amplitude level of said rectified voltage is directly proportional to an intensity level of said signal wave.

5. The wireless system of claim 1, wherein said first signal includes a coded data stream corresponding to a predetermined frequency code of a corresponding one of said radio frequency identification devices attached to one of the existing misplaced articles.

6. A wireless system for finding a plurality of existing misplaced articles, said wireless system comprising:

a hand-held central monitoring device including means for generating and transmitting a first signal based upon a user input;

a plurality of labeled identification members attached to the existing misplaced articles, each of said labeled identification members including means for generating and transmitting a second signal responsive to said first signal; and wherein said hand-held central monitoring device receives said second signal and further includes means for detecting a location of the existing misplaced article based upon a potency level of said received second signal;

wherein said labeled identification modules are removably attached to the misplaced articles;

wherein said first signal generating and transmitting means comprises:

a plurality of controls;

a tuned frequency signal generating module electrically coupled in series to said controls, said tuned frequency signal generating module generating said first signal based upon a user pressing a selected one of said controls wherein said first signal has a unique frequency level; and a first tuned frequency transducer electrically coupled to said tuned frequency signal generating module, said tuned frequency transducer receiving and transforming said first tuned frequency signal to a signal wave.

7. The wireless system of claim 6, wherein said second signal generating and transmitting means comprises:

a unique radio frequency identification device for receiving and verifying said first signal;

a second tuned frequency transducer electrically coupled to said radio frequency identification device, said second transducer being activated upon receiving said first signal;

a power conditioning circuit electrically coupled to said second transducer, said power conditioning circuit rectifying an alternating voltage generated by said second transducer such that a rectified voltage is generated; and a radio frequency transmitter electrically coupled to said power conditioning circuit and being activated upon receipt of said rectified voltage, said radio frequency transmitter generating and transmitting a second radio frequency signal response to said first signal.

8. The wireless system of claim 7, wherein said central monitoring device further comprises:

an antenna;

a receiver electrically coupled thereto, said receiver receiving said second signal from a detected one of said labeled identification modules;

a signal potency evaluating circuit electrically coupled to said receiver for determining a signal potency of said second signal;

a display screen electrically coupled to said signal potency evaluating circuit for visually displaying a graphical image of a potency level of said second signal; and an audio transducer electrically coupled to said signal potency evaluating circuit, said audio transducer generating and emitting an audible response signal corresponding to said potency level of said second signal.

9. The wireless system of claim 8, wherein an amplitude level of said rectified voltage is directly proportional to an intensity level of said signal wave.

10. The wireless system of claim 6, wherein said first signal includes a coded data stream corresponding to a predetermined frequency code of a corresponding one of said radio frequency identification devices attached to one of the existing misplaced articles.

11. A method for finding a plurality of existing misplaced articles, said method comprising the steps of:

a. providing a hand-held central monitoring device having a plurality of controls and an antenna;

b. from said central monitoring device, generating and transmitting a first signal based upon a user input;

c. attaching a plurality of labeled identification members to the existing misplaced articles;

d. selected ones of said labeled identification members generating and transmitting a second signal responsive to said first signal;

e. said hand-held central monitoring device receiving said second signal; and f. detecting a location of the existing misplaced article based upon a potency level of said received second signal;

wherein step b. comprises the steps of:

i. providing a tuned frequency signal generating module electrically coupled in series to said controls;

ii. said tuned frequency signal generating module generating said first signal based upon a user pressing a selected one of said controls wherein said first signal has a unique frequency level;

iii. providing a first tuned frequency transducer electrically coupled to said tuned frequency signal generating module; and iv. said tuned frequency transducer receiving and transforming said first tuned frequency signal to a signal wave.

12. The method of claim 11, wherein step d. comprises the steps of:

a. providing a unique radio frequency identification device;

b. said unique radio frequency identification device receiving and verifying said first signal;

c. providing a second tuned frequency transducer electrically coupled to said radio frequency identification device;

d. activating said second transducer upon receiving said first signal;

e. providing a power conditioning circuit electrically coupled to said second transducer;

f. said power conditioning circuit rectifying an alternating voltage generated by said second transducer such that a rectified voltage is generated; and g. providing a radio frequency transmitter electrically coupled to said power conditioning circuit;

h. activating said radio frequency transmitter upon receipt of said rectified voltage; and i. said radio frequency transmitter generating and transmitting a second radio frequency signal response to said first signal.

13. The method of claim 12, wherein an amplitude level of said rectified voltage is directly proportional to an intensity level of said signal wave.

14. The method of claim 11, wherein step f. comprises the steps of:

a. providing a receiver electrically coupled to said antenna;

b. said receiver receiving said second signal from a detected one of said labeled identification modules;

c. providing a signal potency evaluating circuit electrically coupled to said receiver;

d. said signal potency evaluating circuit determining a signal potency of said second signal;

e. providing a display screen electrically coupled to said signal potency evaluating circuit;

f. said display screen visually displaying a graphical image of a potency level of said second signal;

g. providing an audio transducer electrically coupled to said signal potency evaluating circuit; and h. said audio transducer generating and emitting an audible response signal corresponding to said potency level of said second signal.

15. The method of claim 14, wherein said first signal includes a coded data stream corresponding to a predetermined frequency code of a corresponding one of said radio frequency identification devices attached to one of the existing misplaced articles.

* * * * *